US006182433B1

(12) United States Patent
Tagawa

(10) Patent No.: US 6,182,433 B1
(45) Date of Patent: Feb. 6, 2001

(54) STEEL CORDS FOR THE REINFORCEMENT OF RUBBER ARTICLES

(75) Inventor: Kazuyoshi Tagawa, Kuroiso (JP)

(73) Assignee: Bridgestone Corporation, Tokyo (JP)

( * ) Notice: Under 35 U.S.C. 154(b), the term of this patent shall be extended for 0 days.

(21) Appl. No.: 09/332,136

(22) Filed: Jun. 14, 1999

(30) Foreign Application Priority Data

Jun. 16, 1998 (JP) ..... 10-168859
Jun. 16, 1998 (JP) ..... 10-168860

(51) Int. Cl.[7] ..... D02G 3/36
(52) U.S. Cl. ..... 57/212; 57/902
(58) Field of Search ..... 57/902, 210, 212, 57/200

(56) References Cited

U.S. PATENT DOCUMENTS 4,609,024 * 9/1986 Yatsunami et al. ..... 152/527
5,765,355 * 6/1998 Yanagisawa et al. ..... 57/212
5,802,829 * 9/1998 Yamanaka ..... 57/212

FOREIGN PATENT DOCUMENTS 0 399 795 11/1990 (EP) .
9-156314 6/1997 (JP) .
9-158065 6/1997 (JP) .

* cited by examiner

*Primary Examiner*—William Stryjewski
(74) *Attorney, Agent, or Firm*—Sughrue, Mion, Zinn, Macpeak & Seas, PLLC

(57) ABSTRACT

A steel cord for the reinforcement of rubber article having M parallel+N structure consists of a core of two steel filaments and a single sheath of seven or eight steel filaments, wherein diameters of core filament and sheath filament and twisting pitch have specified ranges, respectively.

8 Claims, 2 Drawing Sheets

STEEL CORDS FOR THE REINFORCEMENT OF RUBBER ARTICLES

BACKGROUND OF THE INVENTION

1. Field of the Invention

This invention relates to a steel cord for the reinforcement of rubber articles, and more particularly to a steel cord usable as a reinforcing member in a belt layer for tuck and bus radial tire (TBR).

2. Description of Related Art

As a steel cord for the reinforcement of a belt in TBR, there has hitherto been used a steel cord of three-layer a structure consisting of a core formed by twisting plural steel filaments and two sheaths formed by twisting steel filaments around the core in two layers. Recently, to reduce the weight and simplify the structure in the belt of TBR, there is widely been used a steel cord of two-layer structure consisting of a core and a single sheath.

Among steel cords of two-layer structure, a steel cord having a core wherein plural steel filaments are arranged in line without twisting is known to have the following merits.

(1) The steel cord can be produced at a single twisting step, so that the economic situation is excellent.

(2) Such steel cords are arranged side by side in a belt layer of a tire to extend in a direction of a line connecting the centers of the core filaments in the cord (hereinafter referred to as a core parallel direction) within a plane of the belt layer. As a result the tire having an excellent steering stability is obtained without damaging ride comfort and the like. Also, the thickness of the belt layer can be thinned, so that tire weight can be reduced.

For example, there are disclosed the following techniques with respect to steel cords for the reinforcement of rubber article having a two-layer structure consisting of a core formed by arranging plural core filaments (M filaments) in parallel to each other without twisting and a single sheath formed by twisting plural sheath filaments (N filaments) around the core (hereinafter referred to as M parallel+N structure).

In JP-A-9-158065 is disclosed a steel cord of M parallel+N structure consisting of a core formed by arranging plural core filaments side by side without twisting and a sheath formed by circumscribing plural sheath filaments with the core filaments and twisting the sheath filaments around the core, and having an elliptical shape at its section.

In JP-A-9-156314 is disclosed a steel cord of 2 parallel+N structure (N=5–8) consisting of a core formed by arranging two core filaments of same diameter side by side without twisting and a sheath formed by helically winding 5–8 sheath filaments, each having a diameter corresponding to 0.8–1.2 times the diameter of the core filament, around the core close thereto at a pitch corresponding to 40–60 times the diameter of the sheath filament while forming a gap between the sheath filaments, and having substantially an elliptical shape at its sectional profile.

However, the conventional steel cords of M parallel+N structure have the following problems.

(1) Since the difference in load bearing between the core filament and the sheath filament is large, the efficiency of developing strength and durability are poor.

(2) The core filaments are easy to cross to each other.

(3) Since an internal distorsion remains between the core and the sheath, when a rubberized sheet containing a plurality of such steel cords arranged side by side is cut, it is easy to cause warping at a cut end portion of the sheet.

Therefore, the handling of the cut sheet is poor in the production of the tire.

SUMMARY OF THE INVENTION

It is, therefore, an object of the invention to solve the aforementioned problems and to provide steel cords for the reinforcement of rubber articles wherein cross portions of the core filaments hardly exist in the steel cord of M parallel+N structure and the residual internal distorsion is small and the efficiency of developing the strength and the durability are excellent.

The inventors have made various studies in order to solve the above problems and have found that the above object can be attained by rationalizing a filament diameter and a ratio of twisting pitch in a steel cord for the reinforcement of rubber article having 2 parallel+7 structure or 2 parallel+8 structure and as a result the invention has been accomplished.

According to a first aspect of the invention, there is the provision of a steel cord for the reinforcement of rubber article consisting of a core formed by arranging two straight core filaments having a diameter dc side by side in a longitudinal direction without twisting and a sheath formed by twisting seven sheath filaments having a diameter ds around the core, and having a flat profile at its section, wherein the diameter dc of the core filament is within a range of 0.30–0.38 mm, and the diameter ds of the sheath filament is not more than dc+0.03 mm but not less than dc−0.03 mm, and a twisting pitch P of the sheath filament is not less than 50 times the diameter dc of the core filament but not more than 120 times the diameter ds of the sheath filament.

In preferable embodiments of the first aspect of the invention, the diameter dc of the core filament is within a range of 0.32–0.36 mm, and the diameter ds of the sheath filament is not more than dc+0.03 mm but not less than dc−0.01 mm, and the twisting pitch P is not less than 60 times the diameter dc of the core filament but not more than 90 times the diameter ds of the sheath filament.

According to a second aspect of the invention, there is the provision of a steel cord for the reinforcement of rubber article consisting of a core formed by arranging two straight core filaments having a diameter dc side by side in a longitudinal direction without twisting and a sheath formed by twisting eight sheath filaments having a diameter ds around the core, and having a flat profile at its section, wherein the diameter dc of the core filament is within a range of 0.30–0.38 mm, and the diameter ds of the sheath filament is not more than dc−0.01 mm but not less than dc−0.05 mm, and a twisting pitch P of the sheath filament is not less than 50 times the diameter dc of the core filament but not more than 120 times the diameter ds of the sheath filament.

In preferable embodiments of the second aspect of the invention, the diameter dc of the core filament is within a range of 0.32–0.36 mm, and the diameter ds of the sheath filament is not more than dc−0.01 mm but not less than dc−0.03 mm, and the twisting pitch P is not less than 60 times the diameter dc of the core filament but not more than 90 times the diameter ds of the sheath filament.

BRIEF DESCRIPTION OF THE DRAWINGS

The invention will be described with reference to the accompanying drawings, wherein.

DESCRIPTION OF PREFERRED EMBODIMENTS

The steel cords for the reinforcement of rubber article according to the invention are described with reference to FIGS. 1 and 2.

Figure 1:
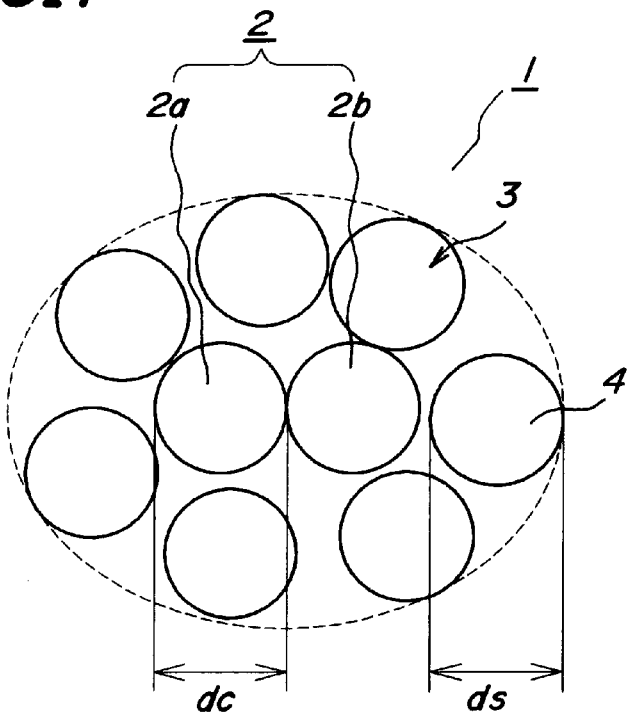
FIG. 1 is a diagrammatical section view of a first embodiment of the steel cord according to the invention.

In FIG. 1 is shown a diagrammatical section view of a first embodiment of the steel cord according to the invention. The steel cord 1 consists of a core 2 and a single sheath 3. The core 2 is formed by arranging two core filaments 2*a* and 2*b* side by side without twisting. The core filaments 2*a* and 2*b* have substantially the same diameter dc in which the diameter dc is within a range of 0.30–0.38 mm.

The sheath 3 is formed by twisting seven sheath filaments 4 around the core 2. All sheath filaments 4 have substantially the same diameter ds in which the diameter ds is not more than dc+0.03 mm but not less than dc−0.03 mm. Also, a twisting pitch P of the sheath filament 4 is not less than 50 times the diameter dc of the core filament but not more than 120 times the diameter ds of the sheath filament. As shown in FIG. 1, the profile at the section of the steel cord 1 is rendered into substantially an elliptical shape by winding the seven sheath filaments 4 around the core filaments 2*a* and 2*b* to substantially contact therewith. As the core filaments 2*a*, 2*b* and the sheath filaments 4 is used a brass plated steel filament having a tensile strength of not less than 2800 MPa, preferably not less than 3000 MPa.

Figure 2:
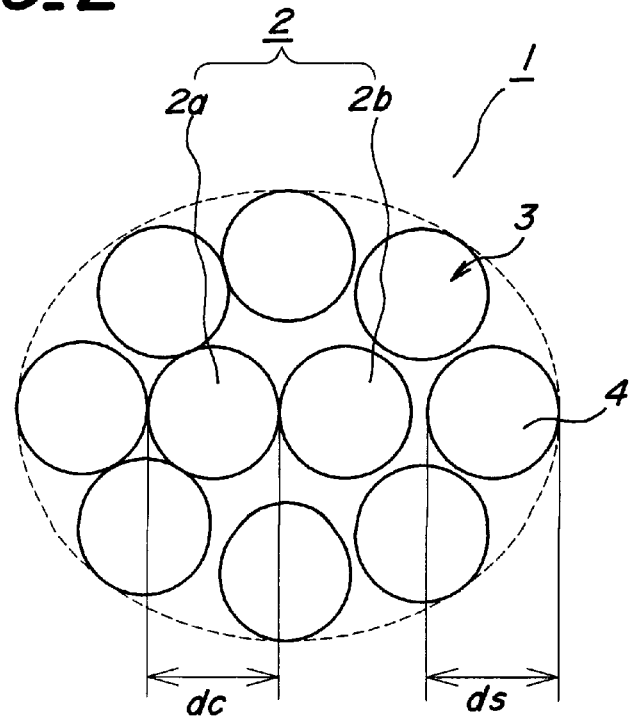
FIG. 2 is a diagrammatical section view of a second embodiment of the steel cord according to the invention.

In FIG. 2 is shown a diagrammatical section view of a second embodiment of the steel cord according to the invention. The steel cord 1 consists of a core 2 and a single sheath 3. The core 2 is formed by arranging two core filaments 2*a* and 2*b* side by side without twisting. The core filaments 2*a* and 2*b* have substantially the same diameter dc in which the diameter dc is within a range of 0.30–0.38 mm.

The sheath 3 is formed by twisting eight sheath filaments 4 around the core 2. All sheath filaments 4 have substantially the same diameter ds in which the diameter ds is not more than dc−0.01 mm but not less than dc−0.05 mm. And also, a twisting pitch P of the sheath filament 4 is not less than 50 times the diameter dc of the core filament but not more than 120 times the diameter ds of the sheath filament. As shown in FIG. 2, the profile at the section of the steel cord 1 is rendered into substantially an elliptical shape by winding the eight sheath filaments 4 around the core filaments 2*a* and 2*b* so as to substantially contact therewith. As the core filaments 2*a*, 2*b* and the sheath filaments 4 is used a brass plated steel filament having a tensile strength of not less than 2800 MPa, preferably not less than 3000 MPa.

As the basic structure of the steel cord for the reinforcement of rubber article according to the invention, the adoption of 2 parallel+7 structure wherein the diameter ds of the sheath filament is not more than dc+0.03 mm or 2 parallel+8 structure wherein the diameter ds of the sheath filament is not less than dc−0.01 mm is based on the following reasons. Firstly, the reason why the number of the core filaments is 2 is due to the fact that when the number of the core filaments is 3 or more, it is easy to form a portion that the core filaments are not arranged in a line at the section of the steel cord and if such steel cords are used for reinforcing a belt layer of a tire, there is damaged the effect capable of thinning the thickness of the belt layer. Secondly, when the number of the sheath filaments is 7 with the diameter ds of the sheath filament satisfying not more than dc+0.03 mm, or when the number of the sheath filaments is 8 with the diameter ds of the sheath filament satisfying not more than dc−0.01 mm, a gap between the sheath filaments having a size capable of sufficiently penetrating rubber thereinto can easily be formed without being extremely biased.

The reason on the limitations of the core filament diameter dc, sheath filament diameter ds and twisting pitch P in the steel cord according to the invention are described below.

The reason why the diameter dc of the core filament is limited to a range of 0.30–0.38 mm is due to the fact that when it is less than 0.30 mm, satisfactory strength and rigidity as a cord for the reinforcement of a belt layer in TBR can not be ensured in the above basic structure. When it exceeds 0.38 mm, winding curl is formed on the core filaments arranged side by side in the winding on a spool and a straightness is lost. Preferably, the core filament diameter dc is within a range of 0.32–0.36 mm.

Furthermore, when the diameter ds of the sheath filament is not more than dc+0.03 mm but not less than dc−0.03 mm in the 2 parallel+7 structure, or not more than dc−0.01 mm but not less than dc−0.05 mm in the 2 parallel+8 structure and the twisting pitch P is not less than 50 times the core filament diameter dc, it has been found that a portion of crossing the core filaments with each other is hardly formed and the residual distorsion in the inside of the cord can be controlled. This will be described in detail below.

Figure 3:
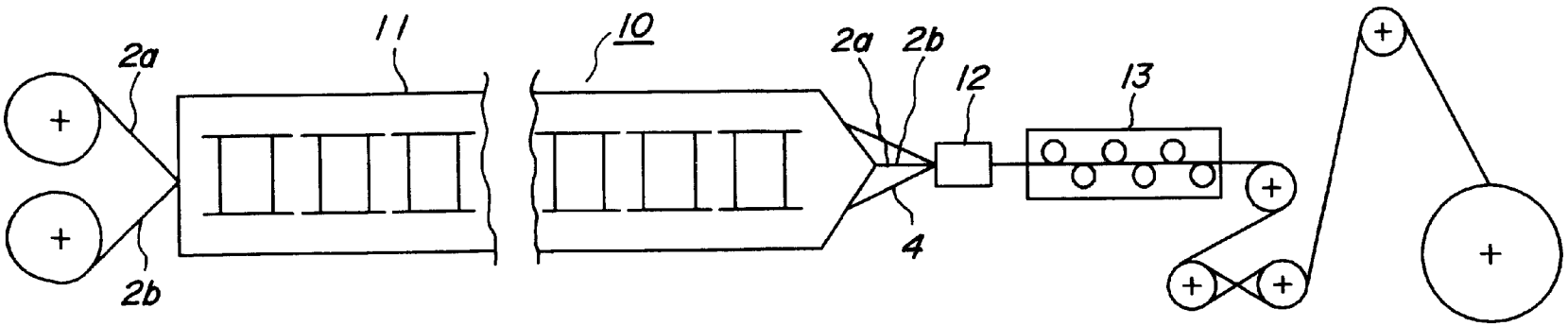
FIG. 3 is a schematic view of an apparatus for producing the steel cord according to the invention.

In FIG. 3 is shown an apparatus for producing the steel cord of 2 parallel+7 or 8 structure according to the invention. Two core filaments 2*a* and 2*b* are fed to a tubular cabling machine 10 and pass through a rotating barrel 11 in the machine 10, while seven or eight sheath filaments 4 are fed from the inside of the barrel 11 and twisted around the core filaments at a cabling die 12 to form a steel cord of 2 parallel+7 or 8 structure. In this case, a core parallel direction must theoretically be constant, but distortion is actually caused by resistance to passage through the barrel or the like. Since the twisting of the sheath filaments 4 at the twisting die 12 serves to correct such a distortion, if the distortion is excessive, there is rather caused a problem that a portion of crossing the core filaments with each other is formed or a large residual distortion is caused in the inside of the cord.

In order to decrease the distortion of the core parallel direction in the passing through the barrel 11, there is a method of increasing a passing rate of the core filament 2*a*, 2*b* to the rotating speed of the barrel 11 or making the twisting pitch P large. Concretely, in case of using the conventional cabling machine, the twisting pitch P is made not less than 50 times, preferably not less than 60 times the diameter dc of the core filament. As a result, the distortion in the core parallel direction can sufficiently be decreased to considerably control the crossing of the core filaments or the occurrence of large residual distortion in the correction through the twisting of the sheath filaments 4. However, when the twisting pitch P is too large, the stability in the shape of the sheath given by the twisting is degraded, so that the twisting pitch is not more than 120 times, preferably not more than 90 times the diameter ds of the sheath filament.

On the other hand, when the sheath filament diameter ds is less than dc−0.03 mm in the 2 parallel+7 structure or less than dc−0.05 mm in the 2 parallel+8 structure, the rigidity of the sheath filament is small and it is required that in order to sufficiently correct the distortion of the core parallel direction, the sheath filaments are twisted so as to have a large potential distortion in the sheath against the distortion of the core. In this case, a rotating quantity of the sheath becomes large at a cut end portion of the thus twisted steel cord, so that when cutting a rubberized sheet containing a plurality of such steel cords arranged side by side, it is easy to largely warp the cut end portion of the sheet. Therefore, the sheath filament diameter ds is not less than dc−0.03 mm, preferably not less than dc−0.01 mm in the 2 parallel+7 structure or not less than dc−0.05 mm, preferably not less than dc−0.03 mm in the 2 parallel+8 structure.

Since the difference between the core filament diameter dc and the sheath filament diameter ds is not more than 0.03 mm in the 2 parallel+7 structure or not more than 0.05 mm in the 2 parallel+8 structure, when the steel cord is subjected to repetitive bending or the like through rollers in a correcting device 13, the difference of bending strain between the core filament and the sheath filament is small and the straightness, distortion and the like can effectively be corrected.

In the invention, the above limitations of the sheath filament diameter ds and the twisting pitch P develops an effect of mitigating the difference of load bearing between the core filament and the sheath filament in the M parallel+N structure. According to the invention, therefore, there can be provided steel cords having excellent strength developing efficiency and durability.

The following examples are given in illustration of the invention and are not intended as limitations thereof.

A steel wire containing about 0.82% by weight of carbon and having a brass plated layer on its surface is used as a steel filament and fed to an apparatus shown in FIG. 3 to produce steel cords as shown in Tables 1 and 2.

In Table 1, Examples 1–7 are steel cords of 2 parallel+7 structure according to the invention and Comparative Examples 1–5 are comparative steel cords of 2 parallel+7 structure.

In Comparative Example 1, the twisting pitch P is too large and outside the range defined in the invention. In Comparative Example 2, the twisting pitch P is too small and is outside the range defined in the invention. In Comparative Example 3, the sheath filament diameter ds is excessively small as compared with the core filament diameter dc and is outside the range defined in the invention. In Comparative Example 4, the sheath filament diameter ds is excessively large as compared with the core filament diameter dc and is outside the range defined in the invention. In Comparative Example 5, the core filament diameter dc is too large and is outside the range defined in the invention.

In Table 2, Examples 8–13 are steel cords of 2 parallel+8 structure according to the invention and Comparative Examples 6–10 are comparative steel cords of 2 parallel+8 structure.

In Comparative Example 6, the twisting pitch P is too large and outside the range defined in the invention. In Comparative Example 7, the twisting pitch P is too small and is outside the range defined in the invention. In Comparative Example 8, the sheath filament diameter ds is excessively small as compared with the core filament diameter dc and is outside the range defined in the invention. In Comparative Example 9, the sheath filament diameter ds is the same as the core filament diameter dc and is outside the range defined in the invention. In Comparative Example 10, the core filament diameter dc is too large and is outside the range defined in the invention.

With respect to these steel cords of Examples 1–13 and Comparative Examples 1–10, the following properties are evaluated as follows.

(1) Breaking Load

It is measured by a method of measuring breaking load according to JIS G3510.

(2) Sheath Rotating Quantity at Cut End Portion

A rotating quantity of a cut end portion of a sheath is measured when the steel cord is cut with a cutter.

(3) Rubber Penetrability

A sample is prepared by embedding steel cords in uncured rubber and then curing at 145° C. for 45 minutes, and thereafter a cut section of the steel cord in the sample is observed to evaluate a penetrating state of rubber.

(4) Winding Curl

The steel cord is wound on a spool of 12 cm in core diameter at a winding tension of about 25 N and left to stand for 2 weeks and thereafter the presence or absence of winding curl is measured.

The measured results are also shown in Tables 1 and 2.

TABLE 1

| | | | Example 1 | Example 2 | Example 3 | Example 4 | Example 5 | Example 6 |
|---|---|---|---|---|---|---|---|---|
| Steel core | Structure | | 2 parallel + 7 | 2 parallel + 7 | 2 parallel + 7 | 2 parallel + 7 | 2 parallel + 7 | 2 parallel + 7 |
| | Core filament | diameter dc (mm) | 0.300 | 0.330 | 0.360 | 0.370 | 0.350 | 0.360 |
| | | tensile strength (MPa) | 3403 | 3305 | 3109 | 3089 | 3187 | 3109 |
| | Sheath filament | diameter ds (mm) | 0.300 | 0.320 | 0.340 | 0.370 | 0.360 | 0.350 |
| | | tensile strength (MPa) | 3403 | 3344 | 3256 | 3089 | 3109 | 3187 |
| | ds-dc (mm) | | 0 | −0.010 | −0.020 | 0 | +0.01 | −0.01 |
| | Twisting pitch P (mm) | | 28.0 | 25.0 | 22.0 | 22.0 | 22.0 | 22.0 |
| | P/dc | | 93.3 | 75.8 | 61.1 | 59.5 | 62.9 | 61.1 |
| | P/ds | | 93.3 | 78.1 | 64.7 | 59.5 | 61.0 | 62.9 |
| Evaluation results | Breaking load (N) | | 2355 | 2682 | 2896 | 3217 | 3049 | 2990 |
| | Sheath rotating quantity at cut end portion (turns) | | 1/16 | 1/16 | 2.5/16 | 1.5/16 | 0.5/16 | 1.5/16 |
| | Rubber penetrability | | good | good | good | good | good | goof |
| | Winding curl | | none | none | none | none | none | none |

TABLE 1-continued

| | | | Example 7 | Comparative Example 1 | Comparative Example 2 | Comparative Example 3 | Comparative Example 4 | Comparative Example 5 |
|---|---|---|---|---|---|---|---|---|
| Steel core | Structure | | 2 parallel + 7 | 2 parallel + 7 | 2 parallel + 7 | 2 parallel + 7 | 2 parallel + 7 | 2 parallel + 7 |
| | Core filament | diameter dc (mm) | 0.360 | 0.300 | 0.360 | 0.360 | 0.340 | 0.390 |
| | | tensile strength (MPa) | 3109 | 3403 | 3109 | 3109 | 3256 | 2971 |
| | Sheath filament | diameter ds (mm) | 0.380 | 0.280 | 0.380 | 0.320 | 0.380 | 0.390 |
| | | tensile strength (MPa) | 3050 | 3462 | 3050 | 3344 | 3050 | 2971 |
| | ds-dc (mm) | | +0.02 | −0.020 | +0.020 | −0.040 | +0.04 | 0 |
| | Twisting pitch P (mm) | | 22.0 | 35.0 | 16.0 | 22.0 | 22.0 | 22.0 |
| | P/dc | | 61.1 | 116.7 | 44.4 | 61.1 | 64.7 | 56.4 |
| | P/ds | | 57.9 | 125.0 | 42.1 | 68.0 | 57.9 | 56.4 |
| Evaluation results | Breaking load (N) | | 3282 | 2157 | 3238 | 2676 | 3234 | 3434 |
| | Sheath rotating quantity at cut end portion (turns) | | 0/16 | 2/16 | 6/16 | 6.5/16 | 0.5/16 | 2/16 |
| | Rubber penetrability | | good | bad | good | good | bad | good |
| | Winding curl | | none | none | none | none | none | presence |

TABLE 2

| | | | Example 8 | Example 9 | Example 10 | Example 11 | Example 12 | Example 13 |
|---|---|---|---|---|---|---|---|---|
| Steel core | Structure | | 2 parallel + 8 | 2 parallel + 8 | 2 parallel + 8 | 2 parallel + 8 | 2 parallel + 8 | 2 parallel + 8 |
| | Core filament | diameter dc (mm) | 0.300 | 0.320 | 0.340 | 0.340 | 0.360 | 0.380 |
| | | tensile strength (MPa) | 3334 | 3275 | 3187 | 3187 | 3040 | 2981 |
| | Sheath filament | diameter ds (mm) | 0.280 | 0.300 | 0.320 | 0.300 | 0.330 | 0.330 |
| | | tensile strength (MPa) | 3393 | 3334 | 3275 | 3334 | 3236 | 3236 |
| | ds-dc (mm) | | −0.020 | −0.020 | −0.020 | −0.040 | −0.030 | −0.050 |
| | Twisting pitch P (mm) | | 25.0 | 22.0 | 22.0 | 22.0 | 22.0 | 22.0 |
| | P/dc | | 83.3 | 68.8 | 64.7 | 64.7 | 61.1 | 57.9 |
| | P/ds | | 89.3 | 73.3 | 68.8 | 73.3 | 66.7 | 66.7 |
| Evaluation results | Breaking load (N) | | 2099 | 2356 | 2621 | 2390 | 2753 | 2794 |
| | Sheath rotating quantity at cut end portion (turns) | | 0.15/16 | 0.5/16 | 1/16 | 2/16 | 1.5/16 | 2.5/16 |
| | Rubber penetrability | | good | good | good | good | good | good |
| | Winding curl | | none | none | none | none | none | none |

| | | | Comparative Example 6 | Comparative Example 7 | Comparative Example 8 | Comparative Example 9 | Comparative Example 10 |
|---|---|---|---|---|---|---|---|
| Steel core | Structure | | 2 parallel + 8 | 2 parallel + 8 | 2 parallel + 8 | 2 parallel + 8 | 2 parallel + 8 |
| | Core filament | diameter dc (mm) | 0.300 | 0.340 | 0.340 | 0.340 | 0.390 |
| | | tensile strength (MPa) | 3334 | 3187 | 3187 | 3187 | 2903 |
| | Sheath filament | diameter ds (mm) | 0.280 | 0.300 | 0.280 | 0.340 | 0.340 |
| | | tensile strength (MPa) | 3393 | 3334 | 3393 | 3187 | 3187 |
| | ds-dc (mm) | | −0.020 | −0.040 | −0.060 | 0 | −0.050 |
| | Twisting pitch P (mm) | | 35.0 | 16.0 | 22.0 | 22.0 | 22.0 |
| | P/dc | | 116.7 | 47.1 | 64.7 | 64.7 | 56.4 |
| | P/ds | | 125.0 | 53.3 | 78.6 | 64.7 | 64.7 |
| Evaluation results | Breaking load (N) | | 2116 | 2353 | 2163 | 2832 | 2897 |
| | Sheath rotating quantity at cut end portion (turns) | | 0.5/16 | 7/16 | 7/16 | 1/16 | 4/16 |
| | Rubber penetrability | | bad | good | good | bad | good |
| | Winding curl | | none | none | none | none | presence |

As seen from Tables 1 and 2, all steel cords of Examples 1–13 are excellent in all evaluation terms.

On the contrary, the steel cords of Comparative Examples 1 and 6 are poor in the shape holding property and the rubber penetrability is insufficient.

The steel cords of Comparative Examples 2 and 7 are large in the sheath rotating quantity at the cut end portion and also the crossing portion of the core filaments is frequently created. Furthermore, the efficiency of developing the strength is low as compared with the steel cords of Examples 3 and 11 using the similar steel filaments and hence the breaking load is somewhat low.

The steel cords of Comparative Examples 3 and 8 are large in the sheath rotating quantity at the cut end portion and the residual distorsion of the cord parallel direction is observed.

The steel cords of Comparative Examples 4 and 9 are insufficient in the rubber penetrability.

In the steel cords of Comparative Examples 5 and 10 is caused the winding curl.

As mentioned above, the steel cords for the reinforcement of rubber articles according to the invention can solve the problems of the conventional steel cord of M parallel+N structure such as distortion of core parallel direction, residual inner distortion, increase in difference of load bearing between core filament and sheath filament and the like.

Also, the steel cord for the reinforcement of rubber article according to the invention is particularly suitable for the reinforcement of a belt layer in TBR. When the steel cords are arranged side by side to extend a direction of a line connecting the centers of the core filaments in the cord within a plane of the belt layer, the properties inherent to the M parallel +N structure are sufficiently developed, whereby there are obtained weight-reduced tires having an excellent steering stability without damaging the ride comfort.

What is claimed is:

1. A steel cord for the reinforcement of rubber article consisting of a core formed by arranging two straight core filaments having a diameter dc side by side in a longitudinal direction without twisting and a sheath formed by twisting seven sheath filaments having a diameter ds around the core, and having a flat profile at its section, wherein the diameter dc of the core filament is within a range of 0.30–0.38 mm, and the diameter ds of the sheath filament is not more than dc+0.03 mm but not less than dc−0.03 mm, and a twisting pitch P of the sheath filament is not less than 50 times the diameter dc of the core filament but not more than 120 times the diameter ds of the sheath filament.

2. A steel cord according to claim 1, wherein the diameter dc of the core filament is within a range of 0.32–0.36 mm, and the diameter ds of the sheath filament is not more than dc+0.03 mm but not less than dc−0.01 mm, and the twisting pitch P is not less than 60 times the diameter dc of the core filament but not more than 90 times the diameter ds of the sheath filament.

3. A steel cord according to claim 1, wherein each of said two straight core filaments comprise a brass plated steel filament having a tensile strength of not less than 2800 MPa.

4. A steel cord according to claim 1, wherein each of said sheath filaments comprises a brass plated filament having a tensile strength of not less than 2800 MPa.

5. A steel cord for the reinforcement of rubber article consisting of a core formed by arranging two straight core filaments having a diameter dc side by side in a longitudinal direction without twisting and a sheath formed by twisting eight sheath filaments having a diameter ds around the core, and having a flat profile at its section, wherein the diameter dc of the core filament is within a range of 0.30–0.38 mm, and the diameter ds of the sheath filament is not more than dc−0.01 mm but not less than dc−0.03 mm, and a twisting pitch P of the sheath filament is not less than 60 times the diameter dc of the core filament but not more than 120 times the diameter ds of the sheath filament.

6. A steel cord according to claim 5, wherein the diameter dc of the core filament is within a range of 0.32–0.36 mm, and the twisting pitch P is not more than 90 times the diameter ds of the sheath filament.

7. A steel cord according to claim 5, wherein each of said sheath filaments comprises a brass plated filament having a tensile strength of not less than 2800 MPa.

8. A steel cord according to claim 5, wherein each of said sheath filaments comprises a brass plated filament having a tensile strength of not less than 2800 MPa.

* * * * *